US005522241A

United States Patent [19]

King

[11] Patent Number: 5,522,241

[45] Date of Patent: Jun. 4, 1996

[54] VENTILATED ELASTIC TEXTILE BAND

[75] Inventor: Anthony W. King, Roxboro, N.C.

[73] Assignee: Medical Textiles, Inc., South Boston, Va.

[21] Appl. No.: 455,337

[22] Filed: May 31, 1995

[51] Int. Cl.[6] ..... D04B 23/08; D04B 23/10

[52] U.S. Cl. ..... 66/193; 66/191; 66/192; 602/76

[58] Field of Search ..... 66/190, 191, 192, 66/193, 194, 195, 196; 602/44, 75, 76

[56] References Cited

U.S. PATENT DOCUMENTS

| | | | |
|---|---|---|---|
| 1,139,343 | 5/1915 | Clewley | 66/193 |
| 1,475,325 | 11/1923 | Springthorpe . | |
| 2,845,783 | 8/1958 | Underwood et al. | 66/193 |
| 2,853,806 | 9/1958 | White | 36/11.5 |
| 3,213,646 | 10/1965 | Van Patten | 66/191 |
| 3,570,482 | 3/1971 | Emoto et al. | 66/193 X |
| 3,999,407 | 12/1976 | Odham | 66/193 |
| 4,044,576 | 8/1977 | Kurz | 66/193 |
| 4,074,543 | 2/1978 | Schmidt | 66/193 |
| 4,442,685 | 4/1984 | Matsuda | 66/193 |
| 4,818,316 | 4/1989 | Weinle et al. | 66/193 X |
| 5,125,246 | 6/1992 | Shytles | 66/193 |
| 5,265,445 | 11/1993 | Shytles et al. | 66/192 |

FOREIGN PATENT DOCUMENTS

| | | | |
|---|---|---|---|
| 1585082 | 1/1964 | Germany . | |
| 1806965 | 11/1968 | Germany . | |
| 2105994 | 2/1971 | Germany . | |
| 2536023 | 8/1975 | Germany . | |
| 60755 | 7/1912 | Switzerland | 66/193 |
| 503142 | 2/1971 | Switzerland | 66/193 |
| 914636 | 2/1959 | United Kingdom . | |
| 960731 | 1/1962 | United Kingdom . | |
| 1021768 | 12/1962 | United Kingdom . | |
| 1035841 | 1/1963 | United Kingdom . | |
| 3869 | 2/1994 | United Kingdom . | |

OTHER PUBLICATIONS

Barnhardt Elastic Corporation, Charlotte, NC—Non-elastic crochet warp knitted fabric having pattern of staggered openings (photograph enclosed).

K. D. Darlington, "Raschel Knitting of Spandex Yarns," Knitting Times, Nov. 27, 1972, pp. 38–42.

A. Reisfeld, "Warp Knit Fabrics and Products," Knitted Outerwear Times, Dec. 15, 1969, pp. 28–43.

K. D. Darlington, "How to Produce Pointelle Raschel Strctures for Outerwear," Knitting Times, Feb. 11, 1980, pp. 34–39.

D. F. Paling, "Laid-in Fabrics," Chapter 9 of Warp Knitting Technology, Columbine Press.

B. Wheatley, "Curtain Net Design and Construction," Chapter 4 of Raschel Lace Manufacture, National Knitted Outerwear Association.

S. Raz, Warp Knitting Production, Verlag Melliand Textilberichte GmbH, pp. 220–228.

(List continued on next page.)

*Primary Examiner*—John J. Calvert

*Attorney, Agent, or Firm*—Shefte, Pinckney & Sawyer

[57] ABSTRACT

A ventilated textile elastic band is formed of a crochet-type warp knitted construction from a set of warp yarns respectively formed in warpwise-extending chain stitches in spaced groups of successive adjacent wales separated from each other group by plural wales unoccupied by any warp yarn, a set of elastic yarns extending within the chain stitches of the warp yarns, and a set of filling yarns traversing coursewise within the warp yarn chain stitches in a predetermined filling traversal pattern producing an absence of any filling yarn in selected courses of the unoccupied wales thereby forming parallel lengthwise columns of spaced ventilation openings. The grouped arrangement of the warp yarns and the widthwise traversing of the filling yarns provides widthwise structural integrity to the fabric band while the elastic yarns provide lengthwise stretchability and the ventilation openings permit air and moisture to pass freely through the band.

10 Claims, 2 Drawing Sheets

OTHER PUBLICATIONS

H. Funke, Die Raschelmaschine: Technologie Der Raschelwirkerei, Fachbuchverlag GmbH Leipzig, 1953, pp. 74–77.

A. Reisfeld, Warp Knit Engineering, pp. 338–339 and 388–389.

I. Meuris, Tricot Et Metier Rachel, Les Editions La Maille, pp. 143–145 and 147.

A. Tremelloni et al, 2 Manuale Technico, Per L'Industria Della Maglieria, NIT Editrice, Milan, pp. 42–45.

"Gardinenherstellung (4)," Kettenwirk–Praxis 3/68, Oberstshausen, pp. 67–68.

VENTILATED ELASTIC TEXTILE BAND

BACKGROUND IN THE INVENTION

The present invention relates generally to textile fabrics and, more particularly, to an elongated elastic textile band of indeterminate length formed with openings which permit air and moisture to pass through the fabric.

One of the traditional uses made of elasticized textile fabric bands and webs is in the fabrication of support belts, garments and devices worn on the body to support injured or weakened areas. To provide an optimal level of support in such applications, the textile band or fabric should have a high degree of elastic strength, commonly referred to as the elastic "power" of the fabric, and a correspondingly high degree of structural stability and integrity. Toward this end, elastic bands of the type commonly used in such garments and devices are customarily fabricated in relatively narrow widths, often less than one foot in width, with multiple elastic yarns extending in the warpwise direction in parallel relation to one another to provide substantial lengthwise elasticity to the band, but are generally inelastic in widthwise direction to provide the desired degree of structural integrity.

While elastic bands of the aforedescribed type have proven to perform satisfactorily in support garments and devices, one of the disadvantages is that the structure of the fabric which provides the desirable qualities of high elasticity and structural integrity also results in the fabric having very small interstices between the constituent yarns in the fabric structure such that passage of air and moisture through the fabric structure is significantly inhibited. As a result, support garments and devices made of such fabrics tend to produce excessive localized perspiration at the body areas covered without the ability of the perspiration to evaporate outwardly through the fabric. In turn, such support garments and devices can be uncomfortable if worn for extended time periods.

In an effort to address the foregoing problem, U.S. Pat. No. 5,265,445 discloses a "breathable" elastic fabric of a crochet-type warp knitted fabric construction forming multiple holes in the fabric structure intended to allow ventilation and escape of moisture therethrough. While the fabric described in this patent would likely provide better air and moisture permeability than conventional fabrics having no ventilation holes, the ventilation openings actually provided by this fabric are still relatively small and therefore provide only a minimal improvement over the preexisting state of the art.

SUMMARY OF THE INVENTION

It is accordingly an object of the present invention to provide an elasticized textile band of a crochet-type warp knitted construction having a substantially greater number and size of ventilation openings than that of U.S. Pat. No. 5,265,445, so as to provide significantly greater air and moisture permeability in comparison thereto, while still maintaining sufficient lengthwise elasticity and widthwise structural integrity to be suitable for use in body support belts, garments and devices.

Briefly summarized, the ventilated elastic band of the present invention basically comprises a plurality of warp, elastic and filling yarns interknitted with one another in longitudinally extending wales and transversely extending courses in a crochet-type warp knitted construction. The yarns include a set of warp yarns extending substantially parallel to one another in a lengthwise dimension of the web, each warp yarn being formed in a lengthwise series of chain stitches with the warp yarns being arranged in a plurality of groups each extending in successive adjacent wales and separated from each other group by at least one wale unoccupied by any warp yarn. A set of elastic yarns extends substantially parallel to one another also in the lengthwise dimension of the web, with each elastic yarn extending within the chain stitches in a respective one of the wales occupied by the warp yarns. A set of filling yarns traverse coursewise across the widthwise dimension of the band within the chain stitches in selected wales occupied by the warp yarns in a predetermined filling traversal pattern producing an absence of any filling yarn in selected courses of the wales unoccupied by warp yarns so as to collectively form parallel lengthwise columns of spaced ventilation openings. The grouped arrangement of the warp yarns together with the widthwise traversing filling yarns provides widthwise structural integrity to the fabric while the elastic yarns provide lengthwise stretchability and the ventilation openings permit air and moisture to pass freely through the band.

In one embodiment of the band, each group of warp yarns comprises at least three warp yarns extending in a corresponding number of at least three successive adjacent wales and each plurality of unoccupied wales separating the groups of warp yarns comprises at least two wales. In such embodiment, the warp yarns include a subset of warp yarns each extending in a series of chain stitches in a single wale between two laterally adjacent groups of warp yarns at a spacing of at least one unoccupied wale from each thereof. Specifically, a preferred filling traversal pattern followed by the filling yarns is 1,11,5,11,1,6. Additional filling yarns may be provided at the lateral lengthwise edges of the band following a filling traversal pattern of 1,13,4,13,1,10, to form selvages of the band.

In another embodiment of the band, each group of warp yarns comprises two warp yarns in two successive adjacent wales, with such groups of warp yarns separated from one another by two unoccupied wales and an intervening single wale occupied by a single chain-stitched warp yarn. Two sets of filling yarns are preferably utilized in such embodiment, arranged alternately with one another across the width of the band, one set of filling yarns following a filling traversal pattern of 1,6,1,9,4,9 while the other set of filling yarns follows a filling traversal pattern of 1,7,1,7,etc.

DETAILED DESCRIPTION OF THE PREFERRED EMBODIMENT

Figure 1:
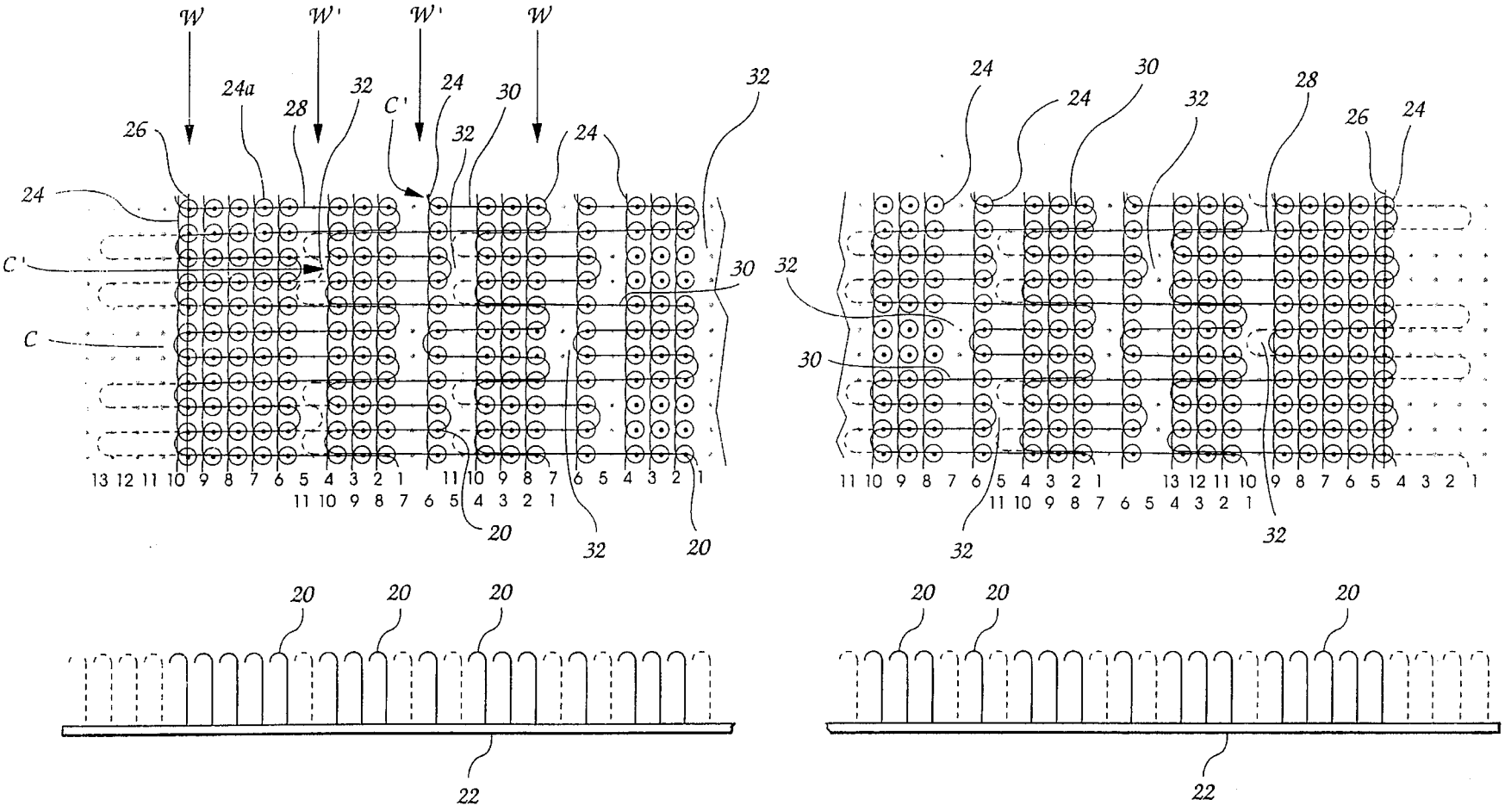
FIG. 1 is a schematic diagram of the knitted structure of a ventilated elastic textile band in accordance with one embodiment of the present invention.

Referring now to the accompanying drawings, a ventilated elastic textile band according to one preferred embodiment of the present invention is depicted schematically in FIG. 1 by means of a traditional point or dot diagram. The band is fabricated of a crochet-type warp knitted construction on a conventional crochet-type warp knitting machine, such as manufactured by Comez S.P.A., of Silavegna, Italy, although those persons skilled in the art will recognize and understand that other forms of textile knitting machinery and knitting methods, e.g., other forms of warp or flat bed knitting machinery, may also be employed for fabricating the band of the present invention Hence, the description of the band fabric of the present invention as being fabricated utilizing a crochet-type warp knitting machine is to be understood as merely being for purposes of illustrating and describing an exemplary embodiment of the invention and not to limit the scope and substance thereof.

The basic construction and operation of crochet-type warp knitting machines is relatively well known and understood. Therefore, it is not believed necessary to illustrate or describe in detail herein the particular structure and operation of such machines. For background reference purposes, such knitting machines basically are equipped with an elongate needle bed extending widthwise across the machine frame with a plurality of knitting needle slots formed in the bed in which knitting needles, typically bearded needles, may be selectively fitted to project outwardly in side-by-side serial arrangement. The needle bed is reciprocated forwardly and rearwardly by an appropriate drive mechanism of the machine to cause all of the knitting needles mounted in the bed to simultaneously execute a unitary reciprocatory knitting action. In conjunction with the needle bed, the knitting machine includes several yarn guide bars also supported widthwise across the machine frame adjacent the needle bed, each operative for feeding yarns to the knitting needles by a reciprocating knitting action synchronized with the reciprocations of the needle bed. As more fully described below, the knitted construction of the preferred embodiment of the present band contemplates the provision of at least one warp yarn guide bar operative to feed a selected number of warp yarns in side-by-side parallel spaced relation to respective knitting needles of the needle bar. Two pairs of filling yarn guide bars also extend widthwise across the machine respectively at opposite sides of the needle bed and are adapted to perform a lateral reciprocating motion in synchronism with the needle bed to feed respective sets of filling yarns in widthwise traversing fashion to the knitting needles. The machine also includes an elastic yarn guide bar adjacent the needle bed to deliver a series of elastic yarns in parallel side-by-side relation to the respective knitting needles of the needle bed simultaneously with the warp yarns.

Each of the guide bars are supported on the frame of the knitting machine by a conventional mechanical arrangement including a patterning mechanism by which respective reciprocatory movements of the guide bars are controlled in timed synchronism relative to the forward-rearward reciprocations of the needle bed to manipulate the respective yarns with respect to the reciprocating needles to effect a knitting action on the yarns to fabricate them progressively into an elongate knitted band of a crochet-type knitted fabric structure of an extended indefinite length. Specifically, the warp yarn guide bars reciprocate laterally from side to side relative to the frame of the knitting machine as well as pivoting upwardly and downwardly to effect a wrapping of the warp yarns about the respective needles of the needle bed. The filling yarn guide bars simultaneously reciprocate side to side of the knitting machine to cause the respective filling yarns to traverse back and forth laterally to lay the filling yarns across selected needles during each reciprocatory cycle of the needle bed. The elastic yarn guide bar simultaneously reciprocates side to side to feed the elastic yarns to the respective needles.

As thus far described, the basic structure and operation of the warp knitting machine is conventional. In accordance with the present invention, the needle bed of the knitting machine, however, is not equipped with a knitting needle in each slot of the bed but, instead, the present invention contemplates that the needle bed be set up with needles omitted from selected slots at spacings along the length of the needle bed and, in conjunction therewith, the filling yarn guide bars execute their lateral traversing motions according to predetermined respective patterns by which ventilation openings are formed in parallel rows extending lengthwise along the band by the selected absence of warp, filling and elastic yarns in the regions of the fabric corresponding to the omitted needles in the needle bed.

As will be more particularly understood with reference to FIG. 1, the stitch constructions of the warp and filling yarns as carried out by the respective reciprocating motions of the yarn guide bars are illustrated in a dot or point diagram format, wherein the individual points 20 represent the needles of the needle bed in the formation of several successive fabric courses C across several successive fabric wales W in the finished fabric. The needle bed is also schematically represented at 22. As will be recognized, at opposite ends of the needle bed whereat the band selvages will be fabricated, the four endmost needle slots are empty, as signified by the broken line representation of knitting needles, with the next five needle slots each being occupied by a respective knitting needle 20 for fabrication of the fabric selvages, as more fully described below. In the needle slots of the needle bed 22 between the outermost selvage needles, the knitting needles 20 are arranged in a repeating pattern of one empty needle slot, three succeeding needle slots occupied by three respective needles 20, one succeeding empty needle slot, one succeeding needle slot occupied by a single needle 20, and one succeeding empty needle slot, etc. In the point diagram, the points corresponding to empty needle slots are shown in phantom to signify the absence of a knitting needle.

In correspondence with the arrangement of needles 20 in the needle bed 22, the warp yarn guide bar (not shown) is equipped with a series of guide eyelets in a corresponding pattern to feed a respective warp yarn 24 through each guide eye to a respective needle 20 in the needle bed 22 in spaced groupings of warp yarns 24 corresponding to the groupings of needles 20. Similarly, the elastic yarn guide bar is equipped with a series of elastic yarn guide eyelets arranged in corresponding groupings to that of the needles 20 and the warp yarn guide eyelets to also feed a respective elastic yarn 26 to each knitting needle 20 simultaneously with the respective warp yarn 24. In the accompanying drawing figure, only two representative elastic yarns 26 are depicted in the two outermost wales of the selvages of the elastic band fabric, for sake of clarity of illustration, it being understood however that an elastic yarn 26 similarly extends with each warp yarn 24 in each other wale W of the knitted fabric which receives a warp yarn 24.

One filling yarn guide bar at each side of the needle bar is equipped with only two yarn guide elements, located at the opposite ends of the guide bar, for feeding two filling yarns 28 to the selvage needles 20 at the corresponding opposite ends of the needle bed 22 according to a filling yarn traversal pattern carried out by such guide bars, as more fully described below. The remaining filling yarn guide bar at each opposite side of the needle bed is equipped with a series of filling yarn guide elements spaced along the length of each respective guide bar to deliver a set of filling yarns 30 to the remaining needles 20 in the needle bed 22 at spacings therealong corresponding to the traversal pattern carried out by such filling yarn guide bars, as more fully described below. For sake of clarity of illustration, the accompanying drawing depicts only the filling yarns 28 and the filling yarns 30 at one side of the knitted band fabric as manipulated by the filling yarn guide bars at one corresponding side of the needle bed 22, but it will be understood by persons skilled in the art that a corresponding set of filling yarns 28,30 is knitted at the opposite side of the elastic band fabric in identical mirror-image relation precisely as illustrated by the filling yarns 28,30.

As depicted in the drawing, the respective reciprocations of the needle bar 22, the warp yarn guide bar, and the elastic yarn guide bar cooperate to cause each warp yarn 24 to be knitted by the respective knitting needle 20 to which it is fed in a series of chain stitches, schematically represented at 24*a*, while simultaneously laying-in the respective elastic yarn to be captured within each succeeding chain stitch 24*a*. Simultaneously, the filling yarn guide bars carrying the selvage filling yarns 28 execute a lateral traversing movement at each opposite side of the fabric in a pattern spanning the thirteen endmost needle spaces (i.e., the spaces intervening adjacent successive needle locations as numerically labeled 1–13 in the drawing figure) in the needle bar 22 at the two opposite ends thereof (including the five selvage needles 20 and the first group of three needles 20 spaced one needle slot therefrom) according to a pattern repeating every six courses during the knitting of the fabric band as signified by the numerical pattern notation 1,13,4,13,1,10 representing the numerical identification of each needle space within the thirteen spaces to which the filling yarn guide elements reciprocate upon each traversal of the filling bar. Simultaneously, the other filling yarn guide bar at each opposite side of the needle bed 22 executes traversals of its filling yarn guide elements in a six-course repeating pattern across eleven needle spaces (respectively labeled numerically 1–11 in the drawing) according to a filling traversal pattern signified by the numerical notation 1,11,5,11, 1,6. As the filling yarn guide bars reciprocate simultaneously with the warp and elastic yarn guide bars and the needle bed 22, the traversing motions of the respective filling yarn guide elements cause the filling yarns to be laid across the active needles during each reciprocatory cycle of the needle bed so as also to be captured within the chain stitches of the warp yarns 24.

As will be recognized by persons skilled in the art, the traversal patterns executed by the respective filling yarn guide bars as described above cause the respective filling yarn guide elements to travel during certain reciprocations past the particular needles to which the respective filling yarns are being fed, but in each case only to a needle space unoccupied by a needle, the actual extent of each such reciprocation of the filling yarn guide elements being represented in the drawing in broken lines with the ultimate disposition of the yarn in the finished fabric being represented in full lines. While this over-reciprocation of the filling yarn guide elements is not necessary to achieve the desired traversing pattern of filling yarns in the fabric, it provides a greater margin for error in properly laying the filling yarns across the active needles during each reciprocatory cycle and thereby enables the knitting machine to be operated at a correspondingly higher production speed than if the filling yarn guide bars travel during each reciprocation only to the endmost needle being supplied with filling yarn.

As will thus be understood, and as is depicted in the accompanying drawing, the described grouping and spacing of the knitting needles 20 in the needle bed 22 in conjunction with the traversal patterns of the filling yarns 28,30 at the selvages of the band and within the main body of the band therebetween form ventilation openings 32 arranged in parallel rows extending lengthwise, i.e., warpwise, along the finished knitted fabric band along the wales W' corresponding to the empty needle slots in the needle bed 22. Each ventilation opening 32 thus occupies two successive courses C' unoccupied by any filling yarn 28,30 across one wale W' unoccupied by any warp yarn 24. As a result, the ventilation openings 32 are substantially larger in area than the ventilation openings known in the prior art described above and, furthermore, occur in a more frequent repeating pattern than in the prior art, to collectively provide substantially greater air and moisture permeability through the present band. At the same time, it will be recognized that the successive filling yarns 28,30 across the widthwise extent of the band overlap with one another across each group of three successive needles 20, thereby providing a substantial degree of widthwise structural stability and integrity to the fabric, substantially comparable to that of a conventional elastic band without ventilation openings. Also, by the appropriate selection of the elastic power of the elastic yarns 26, the overall elasticity and elastic power of the band can be selectively designed to be substantially comparable to that of non-ventilated bands.

Figure 2:
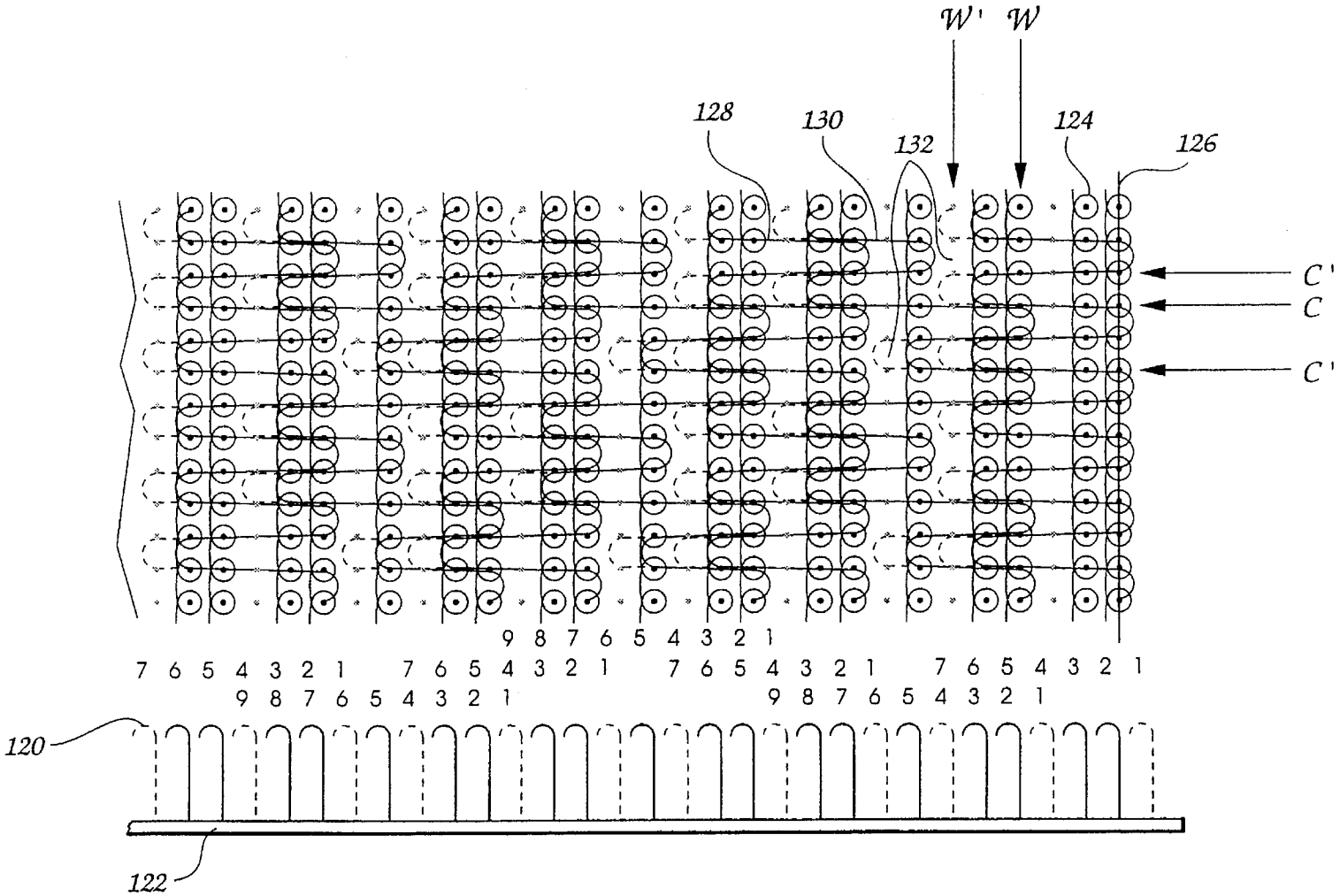
FIG. 2 is a schematic diagram of the knitted structure of a ventilated elastic textile band in accordance with a second embodiment of the present invention.

FIG. 2 depicts another embodiment of a ventilated elastic band in accordance with the present invention, illustrated similarly to the band of FIG. 1 by means of a conventional point diagram. As will be seen, in this embodiment, the needle bed 122 of the knitting machine is set up with the knitting needles 120 arranged in a repeating pattern of two succeeding needle slots occupied by two respective needles 120, one succeeding empty needle slot, one succeeding needle slot occupied by a single needle 120, and one succeeding empty needle slot, etc., depicted in corresponding fashion to that of FIG. 1. Similarly, the warp and elastic yarn guide bars feed warp and elastic yarns to the needles 120 in spaced groupings corresponding to the arrangement of the needles 120 in the needle bed 122 for chain stitch knitting of the warp yarns with the elastic yarns laid therein. The warp yarns are indicated at 124, but for sake of clarity the elastic yarns are not illustrated in FIG. 2 except at 126 in a single wale. Two sets of filling yarns 128,130, respectively, are knitted in the band of FIG. 2 in alternation with one another across the width of the band, the filling yarns 128 following a repeating traversal pattern of 1,7,1,7, etc., while the filling yarns 130 follow a repeating traversal pattern of 1,6,1,9,4,9, as depicted schematically in FIG. 2. As with the embodiment of the band of FIG. 1, it is to be understood that filling yarns are knitted in identical mirror-image relation at both sides of the elastic band, the filling yarns 128,130 at only one side of the band being shown in FIG. 2 for sake of clarity.

As will thus be understood, the described grouping and spacing of the knitting needles 120 in conjunction with the traversal patterns of the filling yarns 128,130 cause a plurality of ventilation openings 132 to be formed in the body of the elastic band in parallel rows extending lengthwise (i.e., warpwise) along the wales W' corresponding to the empty needle slots in the needle bed 122, similarly to the arrangement of ventilation openings 32 in the embodiment of FIG. 1. Likewise, as in the band of FIG. 1, the overlapping arrangement of the filling yarns 128,130 across the widthwise extent of the band provides a substantial degree of widthwise stability and integrity to the fabric while the warpwise extending elastic yarns provide substantial lengthwise stretchability to the band.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A ventilated textile elastic band characterized by sufficient structural and dimensional integrity and elasticity for use in body support garments and devices and enhanced air and moisture permeability for enhanced comfort over non-ventilated elastic bands, the band comprising a knitted textile fabric web of a crochet-type warp knitted construction having a plurality of warp, elastic and filling yarns interknitted with one another in longitudinally extending wales and transversely extending courses, the yarns including a set of warp yarns extending substantially parallel to one another in a lengthwise dimension of the web, each warp yarn being formed in a lengthwise series of chain stitches, the warp yarns being arranged in a plurality of groups, each warp yarn group extending in successive adjacent wales and separated from each other group by at least one wale unoccupied by any warp yarn, a set of elastic yarns extending substantially parallel to one another in the lengthwise dimension of the web, each elastic yarn extending within the chain stitches in a respective one of the wales occupied by the warp yarns, and a set of filling yarns traversing coursewise across a widthwise dimension of the web within the chain stitches in selected wales occupied by the warp yarns in a predetermined filling traversal pattern producing an absence of any filling yarn in selected courses of the wales unoccupied by warp yarns collectively forming parallel lengthwise columns of spaced ventilation openings, the grouped arrangement of the warp yarns and the widthwise traversing of the filling yarns providing widthwise structural integrity to the fabric while the elastic yarns provide lengthwise stretchability and the ventilation openings permit air and moisture to pass freely through the web.

2. A ventilated elastic textile band according to claim 1, wherein each warp yarn group is separated from each other warp yarn group by a plurality of wales unoccupied by any warp yarn.

3. A ventilated elastic textile band according to claim 2, wherein each group of warp yarns comprises at least three warp yarns extending in a corresponding number of at least three successive adjacent wales and each plurality of unoccupied wales separating the groups of warp yarns comprises at least two wales.

4. A ventilated elastic textile band according to claim 2, wherein each group of warp yarns comprises at least two warp yarns extending in a corresponding number of at least two successive adjacent wales and each plurality of unoccupied wales separating the groups of warp yarns comprises at least two wales.

5. A ventilated elastic textile band according to claim 1, wherein the pattern of the filling yarns repeats every six courses.

6. A ventilated elastic textile band according to claim 1, wherein the set of warp yarns include a subset of warp yarns each extending in a series of chain stitches in a single wale between two laterally adjacent groups of warp yarns at a spacing of at least one unoccupied wale from each thereof.

7. A ventilated elastic textile band according to claim 6, wherein the filling traversal pattern followed by the filling yarns is 1,11,5,11,1,6.

8. A ventilated elastic textile band according to claim 7, and further comprising a second set of filling yarns wherein the filling traversal pattern followed by the second set of filling yarns is 1,13,4,13,1,10.

9. A ventilated elastic textile band according to claim 8, wherein the second set of filling yarns is disposed within lateral selvages of the band and the first set of filling yarns is disposed within the band between the selvages.

10. A ventilated elastic textile band according to claim 6, wherein the set of filling yarns comprises a first subset of filling yarns which follow a filling traversal pattern of 1,6,1,9,4,9, and a second subset of filling yarns which follow a filling traversal pattern of 1,7, the filling yarns of the first and second subsets being arranged in alternation with one another coursewise of the web.

* * * * *